US008307514B2

(12) United States Patent
Clark, Sr.

(10) Patent No.: US 8,307,514 B2
(45) Date of Patent: Nov. 13, 2012

(54) HINGE MENDER

(76) Inventor: Daniel Fredrick Clark, Sr., Miamsburg, OH (US)

( * ) Notice: Subject to any disclaimer, the term of this patent is extended or adjusted under 35 U.S.C. 154(b) by 432 days.

(21) Appl. No.: 12/564,236

(22) Filed: Sep. 22, 2009

(65) Prior Publication Data

US 2011/0067199 A1 Mar. 24, 2011

(51) Int. Cl.
*E05D 5/10* (2006.01)

(52) U.S. Cl. ..... 16/386; 16/254; 296/146.11

(58) Field of Classification Search ..... 16/2.1, 16/254, 261–263, 273, 386, 368–370; 296/146.11, 296/146.12; 29/402.08, 11; 384/276, 280, 384/226

See application file for complete search history.

(56) References Cited

U.S. PATENT DOCUMENTS 3,806,693 A 4/1974 Miller
4,654,929 A * 4/1987 Fahnders et al. ..... 16/261
4,881,298 A * 11/1989 Turnbull ..... 16/266
5,906,029 A 5/1999 Fox
6,178,593 B1 1/2001 Carlson
7,003,859 B2 2/2006 Lehner
7,059,032 B2 * 6/2006 Lehner ..... 29/402.08
7,568,267 B2 * 8/2009 Lehner ..... 29/11
8,001,665 B2 * 8/2011 Lehner ..... 29/11
2003/0182761 A1 * 10/2003 Kidd ..... 16/386
2004/0231103 A1 11/2004 Magnuson
2006/0225262 A1 * 10/2006 Federico ..... 29/257
2011/0296657 A1 * 12/2011 Lehner ..... 29/11

* cited by examiner

*Primary Examiner* — William L. Miller
(74) *Attorney, Agent, or Firm* — Taft Stettinius & Hollister LLP

(57) ABSTRACT

An automobile hinge repair tool comprising: (a) a base having a substantially planar top surface; and, (b) a cylindrical insert extending generally perpendicularly from the base, the cylindrical insert including an outer circumferential surface extending longitudinally and having a substantially constant radial diameter, where the substantially planar top surface of the base extends radially outward from the outer circumferential surface of the cylindrical insert at least a predetermined distance and, where the cylindrical insert and the base cooperate to create an automobile hinge repair mold.

18 Claims, 8 Drawing Sheets

HINGE MENDER

RELATED ART

1. Field of the Invention

The present disclosure relates to repair of hinges and bushings and, more specifically, to repair of door hinges and replacement of bushings in door hinges for automobiles.

2. Brief Discussion of Related Art

Many automobile door hinges include generally the same structure. A first metal bracket, mounted to the automobile, includes a pair of spaced apart through openings at least partially occupied by corresponding circular bushings. These circular bushings are vertically aligned and interposed by a pair of openings in a second metal bracket that is mounted to the automobile door. A hinge pin is inserted through the four openings (two of which are through the bushings) to mount the brackets to one another and thereby allowing the door to be opened and closed.

After the aforementioned door hinges reach a certain use point, the hinges—usually the bushings—need to be replaced or repaired. More specifically, the bushings wear and eventually fail, thereby leaving the hinge pin to dig into the metal bracket, causing the opening that the hinge pin partially occupies to become oblong or unbounded in cases where the bracket metal surrounding the through opening is cracked or broken off.

For example, General Motors welds all of the S truck door hinge brackets to the vehicle, thereby making it virtually impossible to repair the door hinge bracket while the bracket is mounted to the vehicle. Consequently, replacement of the bushings and/or repair/replacement of the hinge bracket welded to the vehicle requires cutting the bracket from the door post and at the present time it is the only method of repairing the problem. But replacement of the door hinge creates problems for the mechanic because the door hinge must be properly aligned and fitted, which takes significant time because the bracket is ultimately welded to the vehicle—thus mistakes are difficult to remedy.

Factory alignment is virtually impossible as there is only about 0.003" variable off of the centerline allowed between two vertically spaced apart hinges. In an S truck, this spacing is approximately 23". In sum, it is very time consuming, if not impossible, to align the hinges after removal or replacement that duplicates or closely approximates the factory hinge alignment.

In other circumstances, the door hinges may include a bracket that is bolted to the vehicle, generally allowing the hinge bracket to be removed from the vehicle without cutting the bracket and portions of the vehicle. Even in such a circumstance, when the new door hinge is installed, the alignment problem rears its ugly head. This misalignment may be the result of sagging in the metal portions of the vehicle to which the brackets were originally mounted or that the replacement brackets are not exactly the same size as the factor installed brackets.

INTRODUCTION TO THE INVENTION

The present disclosure relates to devices and methods utilized in the repair and replacement of door hinge brackets, including door hinge bushings, while at least a portion of the door hinge remains mounted to the vehicle chassis or vehicle door.

It is a first aspect of the present invention to provide an automobile hinge repair tool comprising: (a) a base having a substantially planar top surface; and, (b) a cylindrical insert extending generally perpendicularly from the base, the cylindrical insert including an outer circumferential surface extending longitudinally and having a substantially constant radial diameter, wherein the substantially planar top surface of the base extends radially outward from the outer circumferential surface of the cylindrical insert at least a predetermined distance and, where the cylindrical insert and the base cooperate to create an automobile hinge repair mold.

In a more detailed embodiment of the first aspect, the cylindrical insert comprises a plurality of cylindrical inserts, at least two of the plurality of cylindrical inserts having different radial diameters and, the plurality of cylindrical inserts are color-coded so that each cylindrical insert having the same radial diameter includes the same color coding. In yet another more detailed embodiment, the base is removably coupled to the cylindrical insert, the cylindrical insert includes an internal cavity and, the base includes a pin extending from the substantially planar top surface, where the pin is adapted to be received within the internal cavity of the cylindrical insert to couple the base to the cylindrical insert. In a further detailed embodiment, the base is removably coupled to the cylindrical insert, the base includes an internal cavity extending from the substantially planar top surface and, the cylindrical insert includes a pin extending in a direction generally perpendicular from the outer circumferential surface, where the pin is adapted to be received within the internal cavity of the base to couple the cylindrical insert to the base. In still a further detailed embodiment, the base includes a plurality of internal cavities extending from the substantially planar top surface and, the cylindrical insert comprises a plurality of cylindrical inserts, at least two of the cylindrical inserts having different radial diameters, and at least two of the plurality of cylindrical inserts each including a pin extending in a direction generally perpendicular from the outer circumferential surface, where the pin is adapted to be received within at least one of the internal cavities of the ceramic base to couple at least one of the plurality of ceramics inserts to the ceramic base.

In yet another more detailed embodiment of the first aspect, each cylindrical insert includes a pin extending in a direction generally perpendicular from the outer circumferential surface, where the pin is adapted to be received within the internal cavity of the base to couple the cylindrical insert to the base and, each of the plurality of cylindrical inserts with different radial diameters includes a pin uniquely sized to correspond to a radial diameter of the cylindrical insert. In still another more detailed embodiment, the base includes a plurality of projections extending from the substantially planar top surface, the cylindrical insert comprises a plurality of cylindrical inserts, at least two of the plurality of cylindrical inserts having different radial diameters, and at least two of the plurality of cylindrical inserts each including a cavity, where at least one of the plurality of projections is adapted to be received within the cavity of at least one of the plurality of cylindrical inserts to couple at least one of the plurality of cylindrical inserts to the base. In a further detailed embodiment, each of the plurality of cylindrical inserts with a different radial diameter includes a cavity having a size correlated to correspond to a radial diameter of the cylindrical insert, where the radial diameters differ, so too does the size of the cavity and, at least two of the plurality of projections of the ceramic base having a size correlated to correspond to different sized cavities of at least two of the plurality of cylindrical inserts. In still a further detailed embodiment, at least one of the base and cylindrical insert are fabricated from a ceramic. In a more detailed embodiment, the tool further comprises a dowel operative to couple the base to the cylindrical insert, wherein both the base and cylindrical insert include corresponding cavities to receive corresponding portions of the dowel.

It is a second aspect of the present invention to provide a method of repairing an automobile door hinge, the method comprising: (a) positioning a cylindrical insert in a deformed through hole of an automobile portion of an automobile door hinge while the automobile portion of the automobile door hinge remains mounted to an automobile, where an internal wall at least partially defines the deformed through hole; (b) positioning a base underneath and adjacent the internal wall of the automobile portion of the automobile door hinge, where the base and cylindrical insert cooperate to create an automobile hinge repair mold, and where the base, cylindrical insert, and internal wall define a cavity; (c) adding material into the cavity while at least the automobile portion of the automobile door hinge remains mounted to the automobile to at least partially fill the cavity with material; and, (d) solidifying and joining the material to the internal wall of the automobile portion of the automobile door hinge.

In a more detailed embodiment of the second aspect, the method further includes the acts of removing the cylindrical insert from the automobile portion of the automobile door hinge and, repositioning the base to no longer be underneath and adjacent the automobile portion of the door hinge, where removing the cylindrical insert and repositioning of the base leaves a new through hole extending through the automobile portion of the door hinge. In yet another more detailed embodiment, the method further includes the act of mounting a circular bushing within the new through hole, where the circular bushing has an outer diameter generally the same as an original diameter of an original through hole when the automobile door hinge was new. In a further detailed embodiment, the new through hole includes a substantially constant diameter. In still a further detailed embodiment, the act adding material to the cavity includes the act of securing the cylindrical insert and the base to the automobile portion of the automobile door hinge before the material is added into the cavity. In a more detailed embodiment, the act adding material to the cavity includes adding a metallic material to the cavity by welding.

In yet another-more detailed embodiment of the second aspect, the method further includes the act of disassembling the automobile door hinge by removing a hinge pin from the deformed through hole of the automobile portion of the automobile door hinge, thereby allowing separation of the automobile portion from a door portion of the automobile door hinge so that the automobile portion remains attached to the automobile, and where disassembly occurs prior to positioning the cylindrical insert into the deformed through hole of the automobile portion. In still another more detailed embodiment, the method further includes the act of reassembling the automobile door hinge by inserting the hinge pin or a new hinge pin through the new through hole of the automobile portion and a hole of the door portion of the automobile door hinge, thereby pivotally coupling the automobile portion to the door portion. In a further detailed embodiment, at least one of the cylindrical insert and the base is fabricated from a ceramic. In still a further detailed embodiment, the act of positioning the base includes mounting the base to the cylindrical insert. In a more detailed embodiment, the method further includes the act of mounting the cylindrical insert to the base, wherein the act of positioning the cylindrical insert and the act of positioning the base occur substantially simultaneously.

It is a third aspect of the present invention to provide a method of repairing an automobile door hinge, the method comprising: (a) inserting a plug into a deformed through hole of a portion of an automobile door hinge while the portion of an automobile door hinge remains mounted to the automobile, the deformed through hole being larger in at least one dimension than the plug, the deformed through hole previously receiving a circular bushing having a first outside diameter, where a circumferential cavity is at least partially formed by the portion of the deformed through hole not occupied by the plug; (b) positioning a platform under a bottom of the deformed through hole, where a substantially planar surface of the platform abuts the portion of the automobile door hinge that defines the bottom of the deformed through hole, where the plug and platform are operative to substantially close off the bottom of the deformed through hole; (c) adding filler into the circumferential cavity, where at least one of the platform and the insert is operative to retain the filler after the filler is added; (d) solidifying the filler to at least partially define a new through hole; and, (e) mounting a new circular bushing at least partially within the new through hole, where the new circular bushing has an outer diameter generally equal to the first outside diameter.

In a more detailed embodiment of the third aspect, the plug is at least one of permanently mounted and removably mounted to the platform. In yet another more detailed embodiment, the method further comprises the acts of removing a hinge pin that couples the portion of the automobile door hinge to a door aspect of the automobile door hinge that is mounted to an automobile door, decoupling the door aspect from the portion of the automobile door hinge after the hinge pin is removed and, removing a worn bushing from the deformed through hole of the portion of the automobile door hinge, where each of the foregoing steps occurs prior to insertion of the plug into the deformed through hole. In a further detailed embodiment, inserting the plug and positioning the platform occur substantially simultaneously. In still a further detailed embodiment, the act of adding filler into the circumferential cavity includes tungsten inert gas welding to add welded metal into the circumferential cavity and, the act of solidifying the filler includes allowing the welded metal to decrease in temperature.

It is a fourth aspect of the present invention to provide a hinge repair kit comprising: (a) a plurality of ceramic cylindrical inserts, at least two of the plurality of cylindrical inserts including a different diameter, where each different diameter is equivalent to a diameter of a stock new door hinge through hole; and, (b) a ceramic base having a substantially planar top surface sized to complementary engage at least one of the plurality of ceramic inserts, where the base and the cylindrical insert are adapted to cooperate to partially define an automobile hinge repair mold.

DETAILED DESCRIPTION

Figure 1:
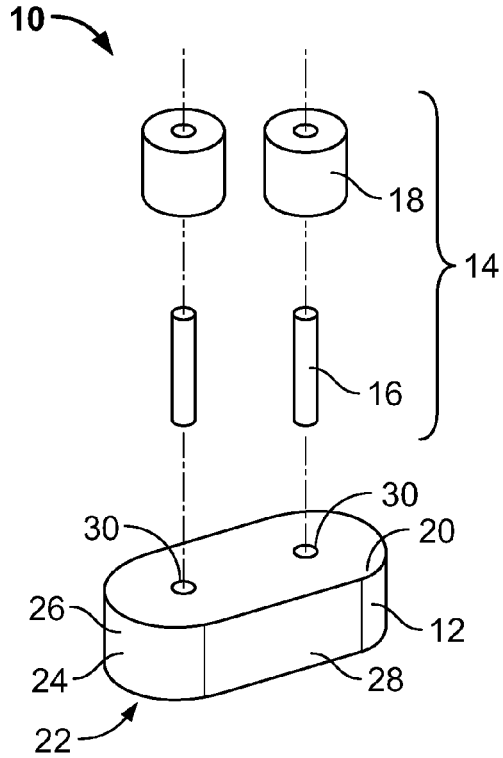
FIG. 1 is an exploded perspective view of an exemplary hinge repair tool in accordance with the present disclosure.
Figure 2:
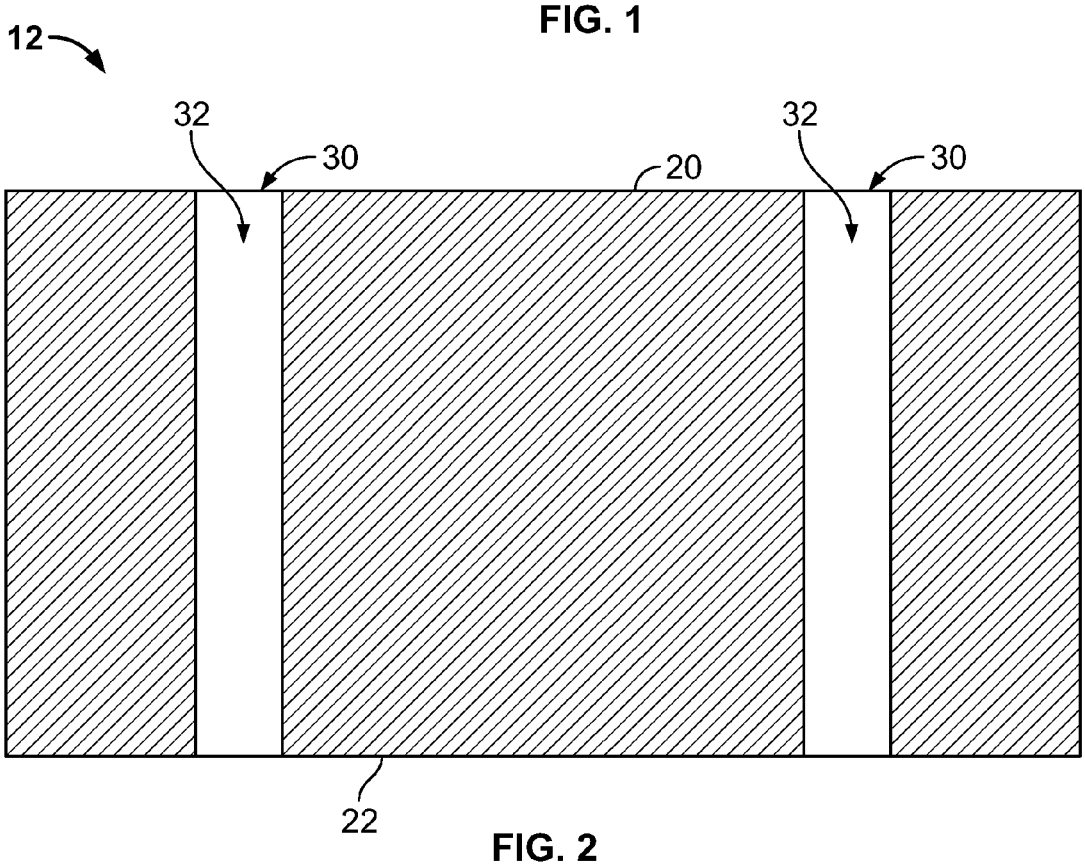
FIG. 2 is a cross-sectional view of an exemplary base taken along line 2-2 of FIG.
Figure 3:
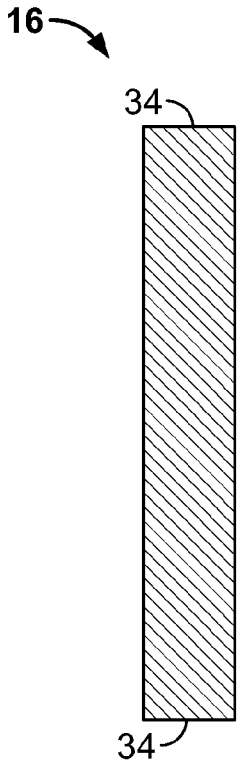
FIG. 3 is a cross-sectional view of an exemplary dowel taken along line 3-3 of FIG. 1.
Figure 4:
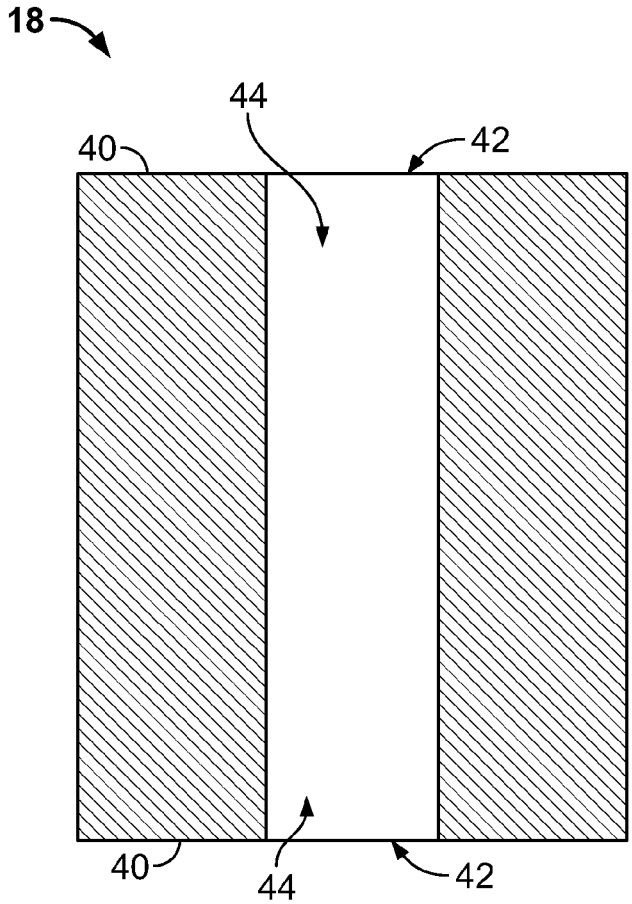
FIG. 4 is a cross-sectional view of an exemplary stopper taken along line 4-4 of FIG. 1.

The exemplary embodiments of the present disclosure are described and illustrated below to encompass methods and associated devices for repairing an automobile door hinge. Of course, it will be apparent to those of ordinary skill in the art that the preferred embodiments discussed below are exemplary in nature and may be reconfigured without departing from the scope and spirit of the present invention. However, for clarity and precision, the exemplary embodiments as discussed below may include optional steps, methods, and features that one of ordinary skill should recognize as not being a requisite to fall within the scope of the present invention.

Referencing FIGS. 1-4, an exemplary hinge repair tool 10 comprises a base 12 and a cylindrical insert 14. In exemplary form, the cylindrical insert 14 may comprise separable elements including a dowel 16 and a cylindrical stopper 18.

The base 12 may be formed of any appropriate material including a ceramic material such as, without limitation, alumina, fused silica, mullite, silicon carbide, zircon, and any combination of the foregoing. The base 12 may be cast or machined to take on virtually any shape, but in this exemplary embodiment the base has an oblong, cylindrical shape. The base 12 includes a substantially planar top surface 20 and an opposed substantially planar bottom surface 22, that are bridged by an outer circumferential surface 24. Both the top and bottom surfaces 20, 22 are generally flat, while the outer circumferential surface 24 is substantially smooth and includes two opposed arcuate sections 26 that are separated by two planar sections 28.

The top surface 20 also includes two openings 30 that lead into cylindrical cavities 32 formed into the base 12 that are spaced ½" apart. In this exemplary embodiment, the cylindrical cavities 32 extend through the bottom surface 22. Nevertheless, it is also within the scope of the disclosure to not allow the cavities to extend through the bottom surface 22. The cylindrical cavities 32 may have the same dimensions or may have different dimensions. In this exemplary circumstance, the cavities 32 have the same dimensions, which are slightly larger than 3/16" in diameter to accommodate the cylindrical 3/16" diameter dowel 16. In exemplary form, the depth of the cavities is approximately ½", which is also the same as the height of the outer circumferential surface 24.

It is also within the scope of the disclosure for the base 12 to have a non-planar top surface 20. Likewise, it is also within the scope of the disclosure for the top surface to include only one cylindrical cavity 32 or include more than two cylindrical cavities 32.

The dowel 16 is also formed of any appropriate material including of a ceramic material such as, without limitation, alumina, fused silica, mullite, silicon carbide, zircon, and any combination of the foregoing. The dowel 16 is cylindrically shaped with a generally circular cross-section with opposed planar end surfaces 34. In this exemplary embodiment, the length of the dowel 16 is approximately ¾", but other lengths could certainly be used. While one end section of the dowel 16 is received within one of the cavities 32 of the base 12, the opposed section of the dowel 16 is adapted to be received by a cylindrical cavity 36 formed through the cylindrical stopper 18.

The cylindrical stopper 18 is also formed of any appropriate material including a ceramic material such as, without limitation, alumina, fused silica, mullite, silicon carbide, zircon, and any combination of the foregoing. This cylindrical stopper 18 includes a circular horizontal cross-section and a substantially constant radial diameter that is matched or very closely approximates the called for specific outside diameter of the through hole of the automobile door hinge bracket. Each end 40 of the stopper 18 includes an opening 42 that opens into a cylindrical cavity 44 that extends longitudinally on the interior of the stopper 18. The cylindrical cavity 44, in this exemplary embodiment, has a substantially uniform diameter slightly larger than 3/16" to accommodate the cylindrical 3/16" diameter dowel 16. In exemplary form, the depth of the cavity 44 is approximately ½".

It is also within the scope of the disclosure to provide multiple cylindrical stoppers 18 having varied outside diameters. In particular, door hinge through holes and corresponding bushings may have original specifications that vary in size to accommodate larger or smaller hinge pins. Accordingly, it is within the scope of the disclosure to provide at least one stopper having an outside diameter that matches or closely approximates the various internal diameters of holes extending through door hinge brackets, which correspondingly are the outside diameters of various bushings. By way of example, and not limitation, a first cylindrical stopper 18 may have an outside diameter of 0.433", while a second cylindrical stopper 18 may have an outside diameter of 0.502", while a third cylindrical stopper may have an outside diameter of 0.556". In other words, the stoppers 18 in exemplary form may have any diameter between 0.433" and 0.556". Each of these stoppers 18 with differing outside diameter may have a unique color coding system associated with it in order to allow easy identification and differentiation. For example, the first cylindrical stopper may include a red pigment giving the stopper a red color, whereas the second cylindrical stopper may include a green pigment giving the stopper a green color, and whereas the third cylindrical stopper may include a violet pigment giving the stopper a violet color. Alternatively, or in addition, the outside of the stopper may be painted with the particular color corresponding to the outside diameter.

It is also within the scope of the disclosure to integrate two or all of the base 12, the dowel 16, and a cylindrical stopper 18. For example, the dowel 16 and stopper 18 may be integrated into a single uniform structure that includes a larger cylinder on top of a smaller cylindrical projection. In this exemplary configuration, the smaller cylindrical projection would be received within one of the openings in the base 12, thereby mounting the integrated dowel and stopper to the base. Conversely, the base 12 and dowel 16 may be integrated into a single uniform structure that includes the substantially planar top surface of the base having a series of projections extending therefrom in a generally perpendicular direction. In this exemplary configuration, the smaller cylindrical projection would be received within a cylindrical cavity formed within or through the stopper 18, thereby mounting the integrated dowel and base to the stopper. Finally, the base 12, dowel 16, and stopper 18 may be integrated in a single integral structure where the substantially planar top surface of the base 12 includes one or more cylindrical projections extending therefrom, where the cylindrical projection(s) has an outside diameter matching the inside diameter of the desired through hole of the door hinge bracket.

Figure 5:
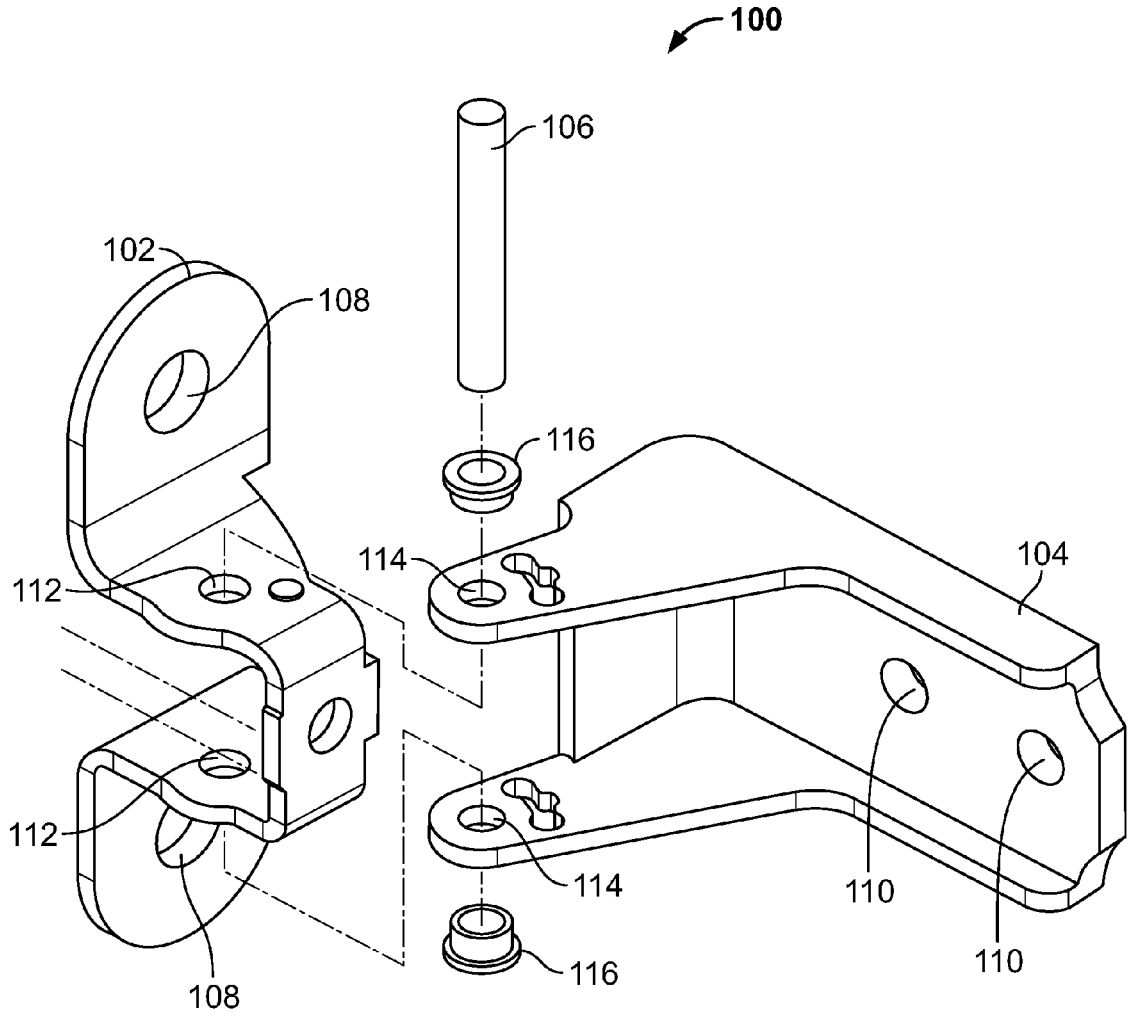
FIG. 5 is an exploded perspective view of an exemplary automobile door hinge.

Referring to FIG. 5, an exemplary automobile door hinge 100 includes a first bracket 102 connected to a second bracket 104 by way of a hinge pin 106. The first bracket 102 is adapted to be mounted to an automobile (not shown) using connector holes 108. These connector holes 108 may receive conventional bolts (not shown) or provide connection points for welding the first bracket 102 to the automobile. Likewise, the second bracket 104 is adapted to be mounted to an automobile door (not shown) using connector holes 110. These connector holes 110 may receive conventional bolts (not shown) or provide connection points for welding the second bracket 104 to the automobile door.

Both the first bracket and second bracket 102, 104 include corresponding pairs of through holes 112, 114 that are vertically aligned in order to accommodate throughput of the hinge pin 106. In this exemplary hinge 100, the through holes 112 also receive corresponding bushings 116. These bushings 116 having an internal diameter slightly larger than the outside diameter of the hinge pin 106 in order to allow the second bracket 104 to rotate about the hinge pin.

Each of the bushings 116 is friction fit within a respective through hole 114 of the second bracket 104. This friction fit requires the bushings 116 to have an outside diameter that is essentially the same as the inside diameter of the through holes 114. In this manner, the bushings 116 do not rotate with respect to the second bracket 104. Accordingly, the point of wear occurs between the outer surface of the hinge pin 106 and the interior surface of the bushing 116. Generally, the bushings 116 are fabricated from a softer material, such as bronze, than compared to the hinge pin 106, which is fabricated from steel. This frictional contact between the outside of the hinge pin 106 and the inside of the bushing 116 results in wear that is most pronounced on the interior surface of the bushing. In some cases, this wear is so severe that it actually wears through the bushing 116 and results in the outer surface of the hinge pin 106 contacting the inner surface of the through holes 114 in the second bracket 104.

When the bushings 116 become worn, play is created between the hinge pin 106 and whatever the surrounding contact surface is, whether it is the bushing 116 or the interior of the through holes 114. This play creates magnified forces upon the second bracket 104 that may lead to cracking of portion of the second bracket defining the through holes 114. In addition, or alternatively, this play may cause the through holes 114 to no longer be circular, but rather take on an oblong shape. Any oblong shape is detrimental to bushing replacement as the bushings 116 are circular and need to be friction fit within a precisely circular through hole 114—otherwise the bushing will not be retained in the through hole or, if retained, will unnaturally deform to the shape of the non-circular through hole and prematurely create play. Consequently, it is very important to reshape the through hole 114 prior to bushing 116 replacement to the extent any deformation in the second bracket 104 has occurred.

While the foregoing example in FIG. 5 has been explained with the bushings 116 being mounted to the second bracket 104, the bushings could well be mounted to the first bracket 102 so that both the hinge pin 106 and the second bracket rotate with respect to the first bracket.

Prior art methods of bushing 116 replacement where the hinge brackets 102, 104 are welded to either the automobile body or door frame necessitated forcefully cutting out the worn hinge bracket before the bushings were replaced. Removal of brackets 102, 104 by cutting them out, not only required significant time and money, but it also created a problem of aligning the new or remanufactured hinge bracket so the door would open and close properly. The instant embodiments address these issues of time, cost, and alignment by allowing the brackets 102, 104 to be repaired and the bushings 116 to be replaced without removing the brackets from the automobile or door frame.

Referring to FIGS. 6-9, an exemplary sequence for repairing an automobile door hinge 200 and replacing the bushings 232 starts with removal of the original hinge pin(s) 202. Removal of the hinge pin(s) 202 allows separation of a first automobile door hinge bracket 204 (automobile portion) from a second automobile door hinge bracket 206 (door portion). In other words, the removal of the hinge pin(s) 202 allows the automobile door 208 (shown in phantom) to be separated from the remainder of the automobile 210 (shown in phantom). In this exemplary circumstance, a pair of hinge bushings 212, 214 were originally mounted to the first hinge bracket 204 in order to allow the hinge pin(s) 202 and second bracket 206 to collectively rotate about through holes 216 in the first hinge bracket 204, thus allowing the automobile door 208 to pivot with respect to the remainder of the automobile 210.

Figure 6:
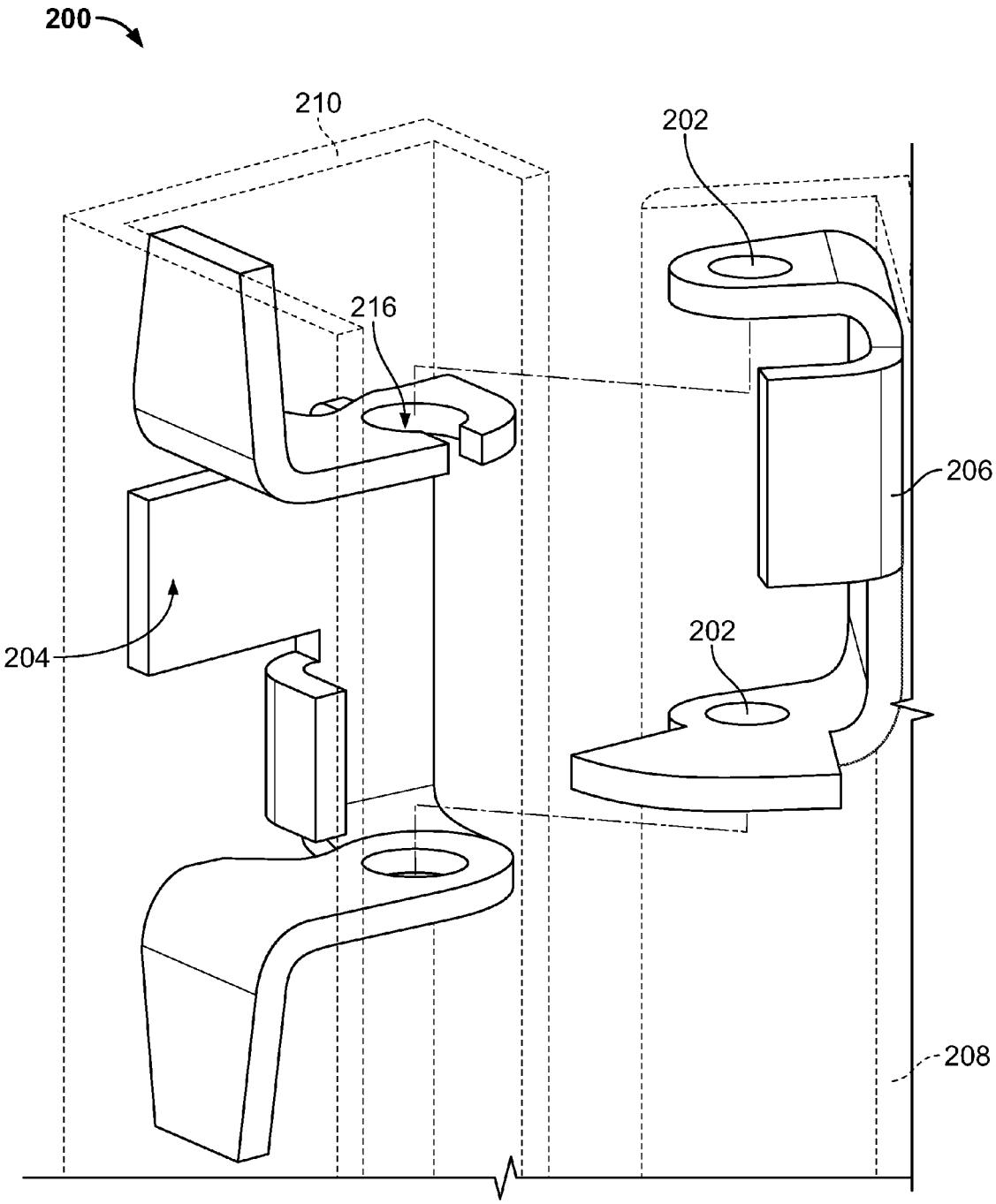
FIG. 6 is an exploded perspective view of another exemplary automobile door hinge to be repaired according to the instant disclosure.

Referring specifically to FIG. 6, after the hinge pins(s) 202 have been removed, the bushings 212, 214 must be removed to assess what damage must be repaired. In this example, the first hinge bracket 204 is welded to the automobile 210 and the hinge bushings 212, 214 are so severely worn that the upper bushing 212 is completely worn through to the corresponding through hole 216, thereby deforming the portion of the bracket 204 that defines the through hole 216, while the lower bushing 214 is almost worn through to the hinge bracket 204. Before using the embodiment of the instant disclosure, the old upper and lower bushings 212, 214 must be removed from the through holes 216. This may be accomplished by cutting the bushings 212, 214 out of the through holes 216 or other known techniques for removal of the bushings. Those skilled in the art are familiar with bushing removal techniques. In this exemplary sequence, after the old upper and lower bushings 212, 214 are removed, it is discovered that the upper through hole 216 is not only oblong, but it is also cracked.

Figure 7:
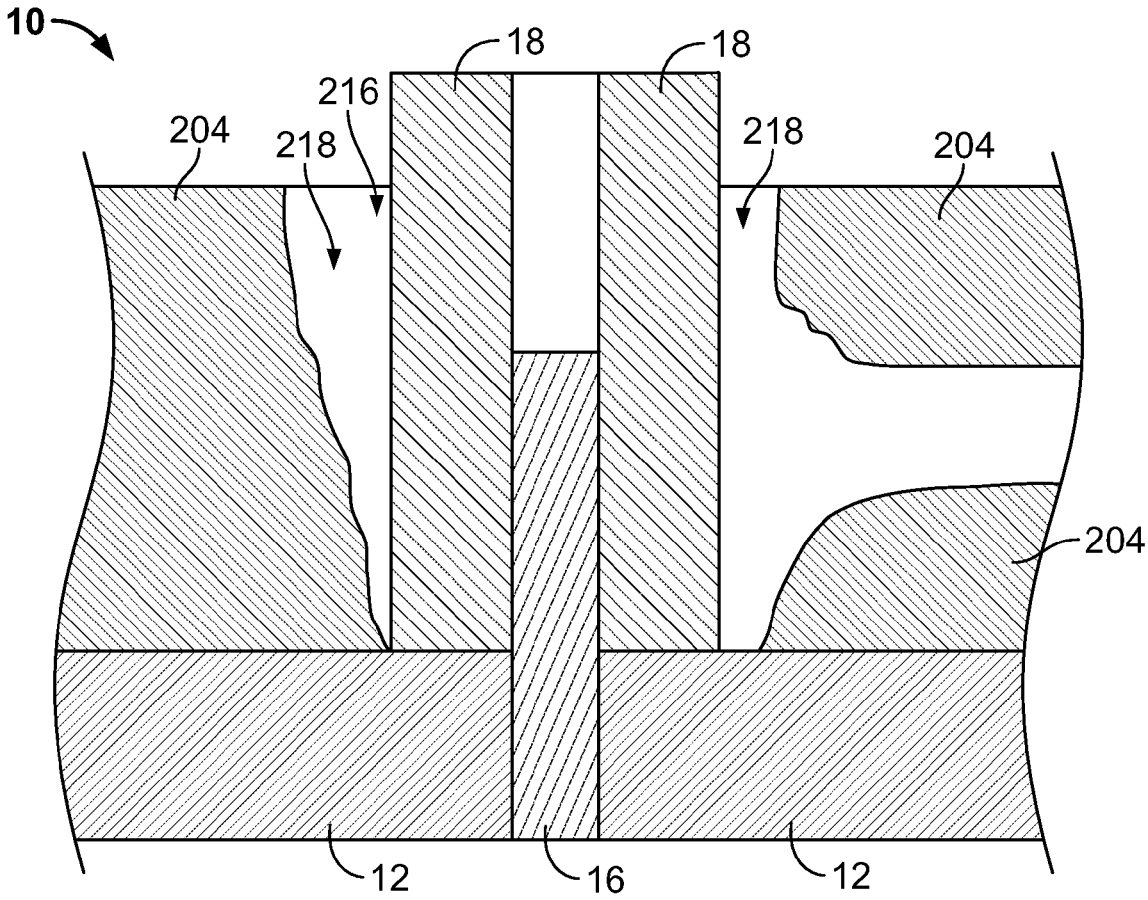
FIG. 7 is an isolated cross-sectional view of the deformed through hole in the exemplary automobile door hinge of FIG. 6, in addition to the exemplary door hinge repair tool being positioned to repair the deformed through hole.
Figure 8:
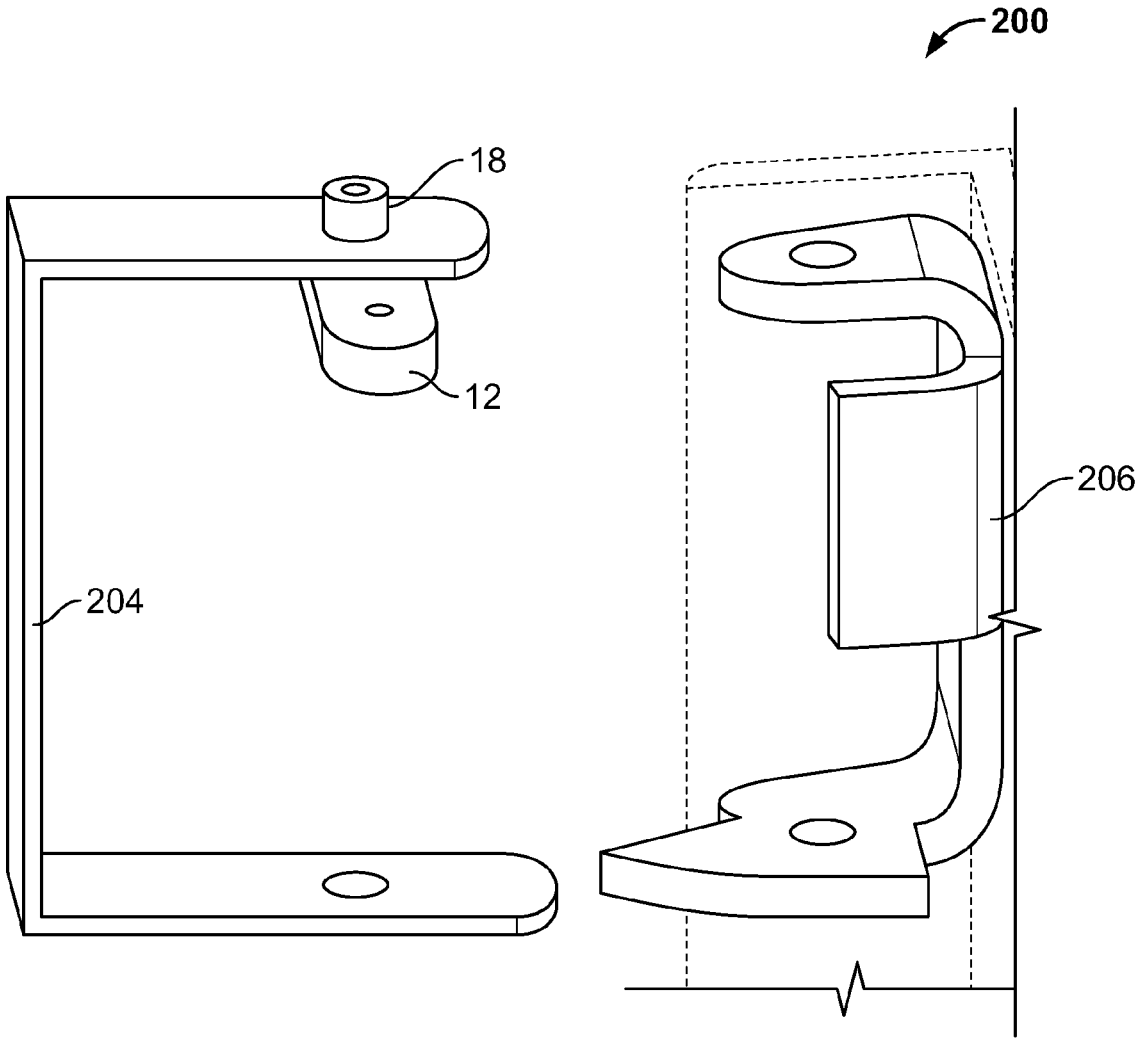
FIG. 8 is an elevated perspective view of the exemplary automobile door hinge of FIG. 6 with the exemplary door hinge repair tool being positioned to repair the deformed through hole.

Referring to specifically to FIG. 7, repair of the first hinge bracket 204 begins by ensuring the through hole 216 are large enough to accommodate throughput of the appropriate stopper 18. By way of example, the stopper is test fit within each of the through holes 216. If the through hole(s) 216 is not large enough or are so deformed that throughput of the correct stopper 18 is not possible, the through hole is drilled out to accommodate the appropriate stopper 18.

The appropriate stopper 18 will have an outer diameter that closely approximates the original diameter of the through hole 216 when the hinge was new or dictated by the hinge specifications. For example, if the top through hole 216 should have an inner circular diameter of 3/16", the appropriate cylindrical stopper 18 is selected that has a corresponding 3/16" outside diameter. Moreover, the depth of the through hole 216 is also checked against the required specification in order to ensure that the stopper 18 has a height that meets or exceeds the depth of the through hole. After the stopper 18 is selected, the hinge repair tool 10 can be assembled and moved in to position. Depending upon the clearance beneath the through hole 216, it may be necessary to assemble the hinge repair tool 10 after the base 12 or stopper 18 is already in position. But if clearance is not an issue beneath the through hole 216, the exemplary hinge repair tool 10 may be assembled prior to insertion of the stopper within the through hole 216.

Referring to FIG. 7, by way of example, the appropriate stopper 18 is mounted to the dowel 16 by insertion of the upper portion of the dowel into the cylindrical cavity 44 of the stopper, which creates a friction fit between the two components. Thereafter, the stopper 18 and dowel 16 are inserted into the through hole 216 from the top or bottom thereof. At generally this same time, before, or after insertion of the stopper 18 and dowel 16, the base 12 is positioned below the through hole 216 so that one of the cylindrical cavities 32 (sec FIG. 2) is generally centered at the desired location of the new through hole 230 (see FIG. 10). The top surface 20 (see FIG. 2) of the base 12 is also adjacent to the bottom surface of first hinge bracket 204 that defines the bottom of the through hole 216, thereby closing off the bottom of the through hole 216. The lower exposed portion of the dowel 16 is inserted through one of the openings 30 on the top surface 20 of the base 12 and into the corresponding cavity 32. This insertion of the dowel 16 into the cavity 32 of the base 12 is operative to mount both the dowel and stopper 18 to the base via a friction fit. It is to be understood that the friction fit may, in exemplary form, not be so tight that the components (stopper 18, dowel 16, and base 12) cannot be disassembled. Alternatively, the assembled hinge repair tool 10 may be moved into position underneath the through hole 210 so that the stopper 18 is inserted through the bottom of the through hole 216 and the base is ultimately positioned flush against the underside of the through hole to close off the bottom of the through hole. After the hinge repair tool 10 is appropriately positioned, as shown in FIG. 7, a cavity 218 is formed in the first hinge bracket 204 between the through hole boundary of the bracket and the outer circumferential surface of the stopper 18. Thereafter, a welding procedure can be carried out to add material to the cavity to repair the through hole 216, as will be discussed below.

Figure 9:
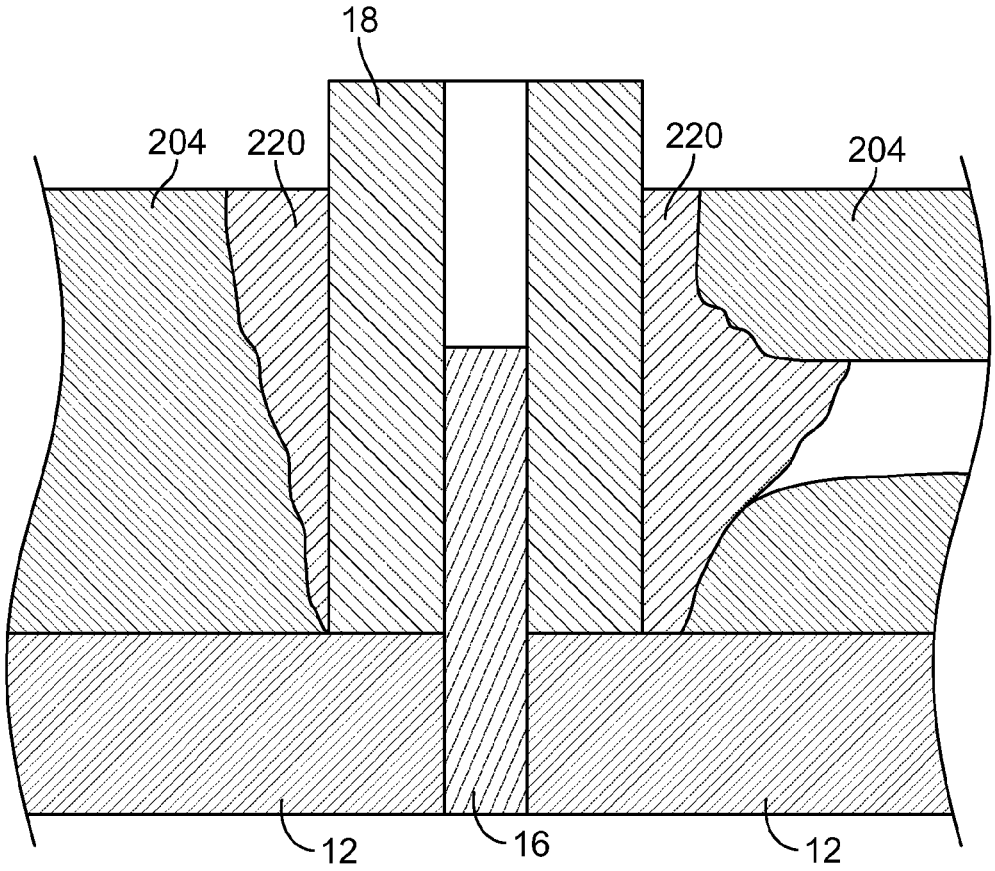
FIG. 9 is the isolated cross-sectional view of FIG. 7 showing added material used to repair the deformed through hole.

Referencing FIG. 9, an exemplary welding procedure includes utilization of a tungsten inert gas (TIG) welder (not shown). Nevertheless, those skilled in the art of welding will readily understand that other welders could be used to carry out the welding procedure discussed below such as, without limitation, metal inert gas (MIG) welders and are welders. After the hinge repair tool 10 is positioned (the tool 10 can be held in position by a clamp (not shown) or by a handle (not shown) pressed from underneath the base 12, a TIG welder with a stainless steel filler rod, for example, is used to create molten metal 220 that at least partially fills the cavity 218 between the oblong through hole's interior circumferential wall and the outer circumferential wall of the stopper 18. The molten metal 220 is drawn downward by gravity and stopped by a combination of the top surface 20 of the base 12, the circumferential wall boundaries of the stopper 18, and the walls of the hinge bracket 204 defining the through hole 216. After the molten metal 220 solidifies, a new cylindrical through hole 230 is formed (see FIG. 10).

Figure 10:
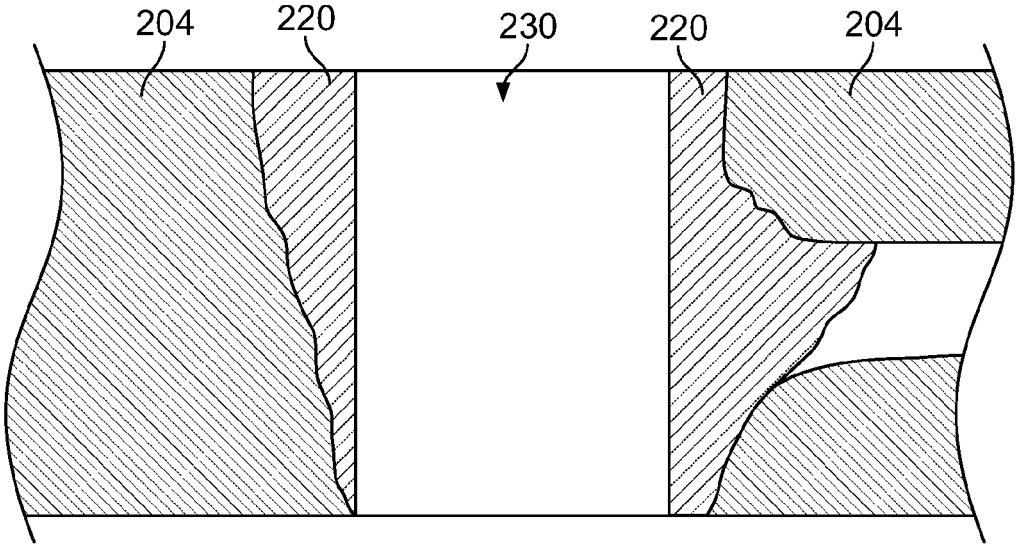
FIG. 10 is the isolated cross-sectional view of FIG. 9 showing the newly formed through hole after the exemplary hinge repair tool is removed from the door hinge bracket.
Figure 11:
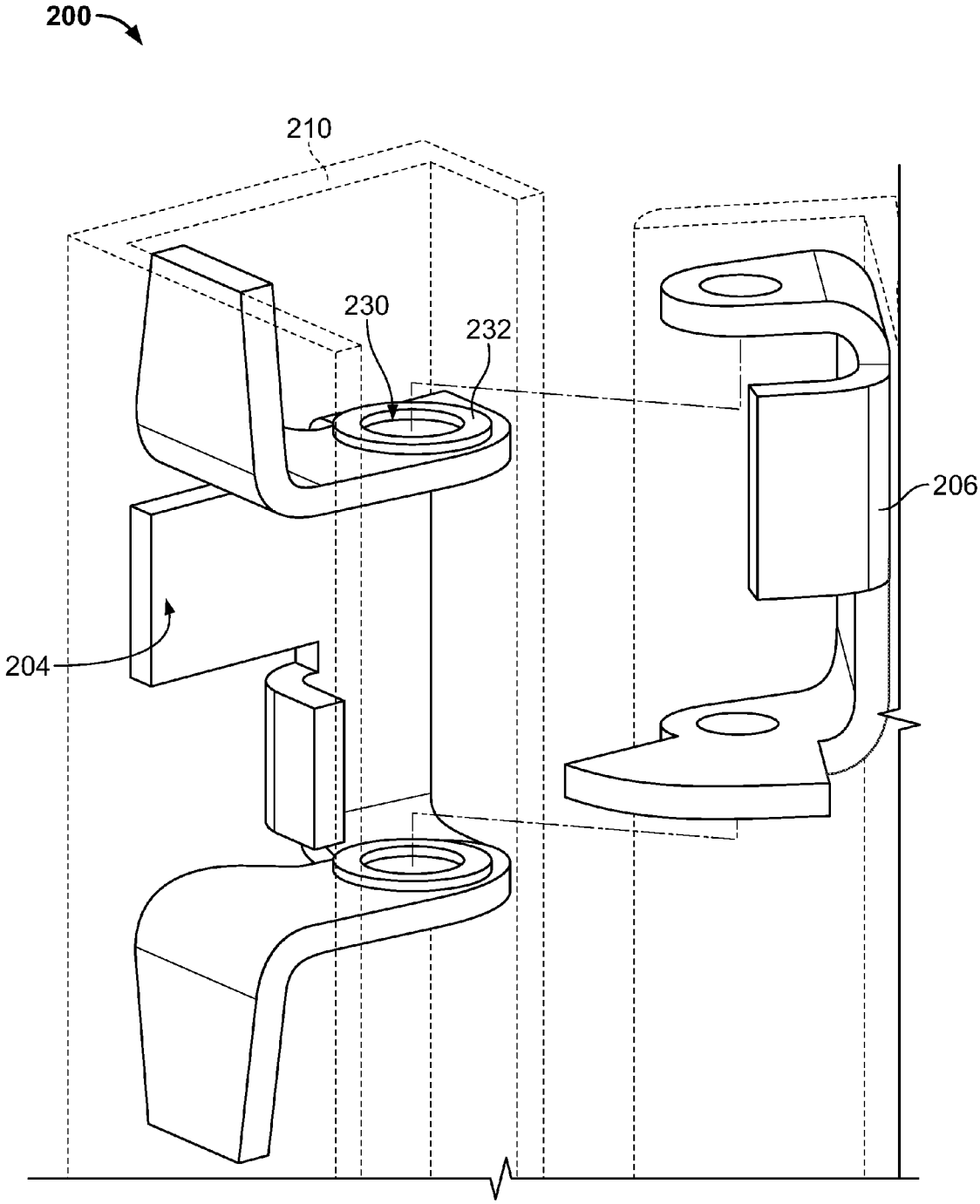
FIG. 11 is elevated perspective view of the repaired exemplary automobile door hinge of FIG. 6.

Referring to FIGS. 9 and 10, in some circumstances, the molten metal 220 may not completely fill the cavity 218. This is acceptable so long as enough of the molten metal 220 is sufficient to receive and circumferentially support a new bushing 232. As shown in FIG. 10, this may include an opening or partial crack in the outer perimeter of the hinge bracket 204. Where the outer perimeter is discontinuous, a MIG or stick welder many be utilized to fill the discontinuities in the outer perimeter of the hinge bracket 204.

The repair tool 10 is retained in position until the molten metal solidifies and has substantially cooled. By retaining the stopper within the newly formed through hole 230, it is assured that the metal will not substantially deform while cooling. After the metal has substantially cooled, the repair tool 10 is removed.

In circumstances where clearance underneath the new through hole 230 does not allow for removal of the entire repair tool 10 as a single unit, disassembly in a piecemeal fashion may occur. In such a circumstance, the base 12 is repositioned vertically downward from the hinge bracket 204 to separate the top surface 20 of the base from the bottom surface of the hinge bracket that defines the new through hole 230. If the stopper 18 is retained within the through hole 230, and the dowel 16 continues to be mounted to the stopper, downward movement of the base is continued until the lower portion of the dowel 16 is free from the base cavity 32. Thereafter, a punch (not shown) may be used to forcibly remove the stopper 18 and dowel 16 from the new through hole 230. If either the stopper 18 or the dowel 16 remains mounted to the base 12, a chisel may be used to sever the connection between the two. In such a circumstance, at least one of the stopper 18 and dowel 16 is adapted to be a replaceable component of the hinge repair tool 10. Any remaining dowel 16 within either the stopper 18 or the base 12 may be removed by a punch.

In exemplary form, the stopper 18 may have a vertical/longitudinal height that extends well above the top of the new through hole 230. This additional height allows a clamping device, such as pliers, to retain the stopper in position within the new through hole 230 as the base 12, and possibly the dowel 16, is removed. After the base 12 is removed, the stopper 18 is removed from the new through hole. Alternatively, the stopper 18, and possibly the dowel 16, are initially removed and thereafter the base 12 is removed to unencumber the new through hole 230.

In some circumstances, the molten metal 220 may pool on top of the bracket 204 and create an uneven bulge or mound around the new through hole 230. In such a circumstance, a grinder or come other means may be used to remove the metal 220 from the top surface of the hinge bracket 204, thereby returning the top surface to a substantially planar top surface or whatever topography the hinge bracket originally had.

Referring to FIG. 10, after the hinge repair tool 10 is removed from the new through hole 230, it can be observed that the new through hole has a diameter that approximates what is called for by the requisite hinge specification and has a substantially continuous, circular internal wall. Those skilled in the art will understand that depending upon the condition and shape of the new through hole 230, it may be desirable to drill out and/or polish the interior of the new through hole 230. Likewise, in order to provide a new bushing with an appropriate mating surface on top of the bracket 204 surrounding the new through hole 230, it may be necessary to grind and/or polish the top surface of the bracket surrounding the new through hole 230.

After the new through hole 230 has been prepared as described above, the new bushing 232 is inserted into the through hole 230 and retained therein by a friction fit. An analogous sequence can be applied to replace the bottom bushing of the hinge bracket 204. After the busing(s) is replaced, the hinge bracket 204, 206 are reattached by aligning the through holes 230, 236 and by inserting the old hinge pin(s) 202 or a new hinge pin in the through holes 230, 236.

Each of the components or the entire exemplary hinge repair tool 10 could be fabricated for repetitive use or could be fabricated for one-time use. By way of example, it is within the scope of the invention for the entire hinge repair tool 10 to be disposable. This may result from the friction fit between the components being such that disassembly of the components could destroy or degrade the components so that repetitive use is inhibited.

While the foregoing exemplary procedure was discussed using metal welding material 220 to redefine a new through hole 230 in the hinge bracket 204, it is also within the scope of the invention that other methods for forming the new through hole 230 may be employed. For example, powdered metal 220 may be added to the cavity 218 formed by the hinge bracket 204, base 12, and stopper 18. Thereafter, the powdered metal may be heated to liquefy the metal and thereafter cooled to solidify the metal. Likewise, alternate materials 220 other than metals may be employed. For example, the cavity 218 may be filled or partially filled with an epoxy or epoxy resin 220. In such a circumstance, the epoxy or epoxy resin 220 is forced into the cavity 218 in a semi-fluid state (i.e., as a paste) and thereafter allowed to cure/solidity. The curing/solidification is also operative to bond the epoxy or epoxy resin to the metal boundary of the hinge bracket 204.

While the foregoing exemplary embodiment has been discussed using ceramics to form the base 12, dowel 16, and stopper 18, it is also within the scope of the invention that other materials such as, without limitation, metals, thermoplastics, epoxies, and ceramic alloys can be utilized to form one or more of the foregoing components.

Following from the above description and invention summaries, it should be apparent to those of ordinary skill in the art that, while the methods and apparatuses herein described constitute exemplary embodiments of the present invention, the invention contained herein is not limited to this precise embodiment and that changes may be made to such embodiments without departing from the scope of the invention as defined by the claims. Additionally, it is to be understood that the invention is defined by the claims and it is not intended that any limitations or elements describing the exemplary embodiments set forth herein are to be incorporated into the interpretation of any claim element unless such limitation or element is explicitly stated. Likewise, it is to be understood that it is not necessary to meet any or all of the identified advantages or objects of the invention disclosed herein in order to fall within the scope of any claims, since the invention is defined by the claims and since inherent and/or unforeseen advantages of the present invention may exist even though they may not have been explicitly discussed herein.

What is claimed is:

1. An automobile hinge repair tool comprising:

a base having a substantially planar top surface; and, a cylindrical insert extending generally perpendicularly from the base, the cylindrical insert including an outer circumferential surface extending longitudinally and wherein the outer circumferential surface includes a constant radial diameter equivalent to a diameter of a stock new door hinge through hole;

wherein the substantially planar top surface of the base extends radially outward from the outer circumferential surface of the cylindrical insert at least a predetermined distance being greater than a vertical depth of the stock new door hinge through hole; and, wherein the cylindrical insert and the base cooperate to create an automobile hinge repair mold.

2. The hinge repair tool of claim 1, wherein;

the cylindrical insert comprises a plurality of cylindrical inserts, at least two of the plurality of cylindrical inserts having different radial diameters; and, the plurality of cylindrical inserts are color-coded so that each cylindrical insert having the same radial diameter includes the same color coding.

3. The hinge repair tool of claim 1, wherein:

the base is removably coupled to the cylindrical insert;

the cylindrical insert includes an internal cavity; and, the base includes a pin extending from the substantially planar top surface, where the pin is adapted to be received within the internal cavity of the cylindrical insert to couple the base to the cylindrical insert.

4. The hinge repair tool of claim 1, wherein:

the base is removably coupled to the cylindrical insert;

the base includes an internal cavity extending, from the substantially planar top surface; and, the cylindrical insert includes a pin extending in a direction generally perpendicular from the outer circumferential surface, where the pin is adapted to be received within the internal cavity of the base to couple the cylindrical insert to the base.

5. The hinge repair tool of claim 1, wherein:

the base includes a plurality of internal cavities extending from the substantially planar top surface; and, the cylindrical insert comprises a plurality of cylindrical inserts, at least two of the cylindrical inserts having different radial diameters, and at least two of the plurality of cylindrical inserts each including a pin extending in a direction generally perpendicular from the outer circumferential surface, where the pin is adapted to be received, within at least one of the internal cavities of the base to couple at least one of the plurality of cylindrical inserts to the base.

6. The hinge repair tool of claim 5, wherein:

each cylindrical insert includes a pin extending in a direction generally perpendicular from the outer circumferential surface, where the pin is adapted to be received within the internal cavity of the base to couple the cylindrical insert to the base; and each of the plurality of cylindrical inserts with different radial diameters includes a pin uniquely sized to correspond to a radial diameter of the cylindrical insert.

7. The hinge repair tool of claim 5, wherein:

each of the plurality of cylindrical inserts with a different radial diameter includes a cavity having a size correlated to correspond to a radial diameter of the cylindrical insert, where the radial diameters differ, so too does the size of the cavity; and, at least two of the plurality of internal cavities of the base having a size correlated to correspond to different sized cavities of at least two of the plurality of cylindrical inserts.

8. The time repair tool of claim 1, wherein:

the base includes a plurality of projections extending from the substantially planar top surface;

the cylindrical insert comprises a plurality of cylindrical inserts, at least two of the plurality of cylindrical inserts having different radial diameters, and at least two of the plurality of cylindrical inserts each including a cavity, where at least one of the plurality of protections is adapted to be received within the cavity of at least one of the plurality of cylindrical inserts to couple at least one of the plurality of cylindrical inserts to the base.

9. The hinge repair tool of claim 1, wherein at cast one of the base and cylindrical insert are fabricated from a ceramic.

10. The hinge repair tool of claim 1, farther comprising a dowel operative to couple the base to the cylindrical insert, wherein both the base and cylindrical insert include corresponding cavities to receive corresponding portions of the dowel.

11. A hinge repair kit comprising:

plurality of ceramic cylindrical inserts at least two of the plurality of cylindrical inserts including a different diameter, where each different diameter is equivalent to a diameter of a stock new door hinge through hole;

a ceramic base having a substantially planar top surface sized to complementary engage at least one of the plurality of ceramic inserts; and, wherein the base and at least one of the plurality of ceramic cylindrical inserts cooperate to partially define an automobile hinge repair mold.

12. An automobile hinge repair kit comprising:

a base having a substantially planar top surface; and, a plurality of cylindrical inserts removably coupled to the base, at least two of the plurality of cylindrical inserts having different radial diameters, where each different radial diameter is equivalent to a diameter of a stock new door hinge through hole, and the plurality of cylindrical inserts are color-coded so that each cylindrical insert having the same radial diameter includes the same color coding;

wherein the substantially planar top surface of the base extends radially outward from an outer circumferential surface of at least one of the plurality of cylindrical inserts at least a predetermined distance; and, wherein at least one of the plurality of cylindrical inserts and the base cooperate to create an automobile hinge repair mold.

13. The hinge repair kit of claim 12, wherein;

at least one of the plurality of cylindrical inserts includes an internal cavity; and, the base includes a pin extending from the substantially planar top surface, where the pin is adapted to be received within the internal cavity to couple the base to at least one of the plurality of cylindrical inserts.

14. The hinge repair kit of claim 13, wherein;

the base includes a plurality of pins extending from the substantially planar top surface, at least two of the pins having differing dimensions; and, the plurality of cylindrical inserts each include an internal cavity, at least two of the plurality of cylindrical inserts having a different sized internal cavity, where at least one of the plurality of pins is adapted to be received within at least one of the internal cavities of the cylindrical inserts to couple at least one of the plurality of cylindrical inserts to the base.

15. The hinge repair kit of claim 12, wherein:

at least one of the plurality of cylindrical inserts includes a projection; and, the base includes a cavity extending from the substantially planar top surface, where the cavity is sized to receive the projection to couple the base to at least one of the plurality of cylindrical inserts.

16. The hinge repair kit of claim 15, wherein:

each of the plurality of cylindrical inserts includes a projection, at least two of the projections having different dimensions; and, the base includes a plurality of different sized internal cavities, where at least one of the projections is adapted to be received within at least one of the plurality of different sized internal cavities of the base to couple at least one of the plurality of cylindrical inserts to the base.

17. The hinge repair kit of claim 12, wherein at least one of the base and cylindrical insert is fabricated from a ceramic.

18. The hinge repair kit of claim 12, further comprising a dowel operative to couple the base to at least one of the plurality of cylindrical inserts, wherein both the base and at least one of the plurality of cylindrical inserts include corresponding cavities to receive corresponding portions of the dowel.

* * * * *